United States Patent [19]

Toya et al.

[11] Patent Number: 4,920,032

[45] Date of Patent: Apr. 24, 1990

[54] SILVER HALIDE PHOTOSENSITIVE MATERIAL

[75] Inventors: Ichizo Toya; Masakazu Yoneyama, both of Kanagawa, Japan

[73] Assignee: Fuji Photo Film Co., Ltd., Kanagawa, Japan

[21] Appl. No.: 280,841

[22] Filed: Dec. 7, 1988

[30] Foreign Application Priority Data

Dec. 7, 1987 [JP] Japan ..... 62-309345

[51] Int. Cl.[5] ..... G03C 1/06

[52] U.S. Cl. ..... 430/536; 430/537; 430/598; 430/599; 430/627; 430/628; 430/634

[58] Field of Search ..... 430/264, 536, 537, 598, 430/599, 627, 628, 634

[56] References Cited

U.S. PATENT DOCUMENTS 4,710,456 12/1987 Naoi et al. ..... 430/564

*Primary Examiner*—Paul R. Michl
*Assistant Examiner*—Janet C. Baxter
*Attorney, Agent, or Firm*—Sughrue, Mion, Zinn, Macpeak & Seas

[57] ABSTRACT

A silver halide photosensitive material comprising at least one silver halide photographic emulsion layer provided on at least one side of a support, said photosensitive material containing in the photographic emulsion layer and/or another component layer (i) a polymer having repetitive units represented by formula (II), dextran or mixtures thereof, and (ii) at least one cationic compound containing quaternary nitrogen:

(II)

wherein $R^1$ represents hydrogen or an alkyl group with 1 to 6 carbon atoms; $R^2$, and $R^3$ each represents hydrogen, or, an unsubstituted or substituted alkyl, aryl or aralkyl group having up to 10 carbon atoms, or $R^2$ and $R^3$ are bonded to each other to form a nitrogen-containing heterocyclic ring; m represents 1 or 2; n represents 0 or 1; and L represents a linking group of the valence m+1.

11 Claims, No Drawings

SILVER HALIDE PHOTOSENSITIVE MATERIAL

FIELD OF THE INVENTION

This invention concerns a high-sensitivity silver halide photosensitive material. Particularly it concerns a silver halide photosensitive material which can be very rapidly developed and which exhibits excellent film quality.

BACKGROUND OF THE INVENTION

In order to achieve a silver halide photosensitive material which is highly sensitive and can be quickly processed, it is important to improve the developing rate of the material.

For high sensitivity photosensitive materials, silver iodide is generally used in view of sensitivity and image quality. However, silver iodobromide emulsions take longer to develop than silver chloride or silver bromide emulsions. Thus, improvement in this area is greatly desired.

Improvements dealing with the above problems have been described in U.S. Pat. Nos. 2,423,549, 2,531,832, 2,533,990 wherein a non-ionic surfactant containing polyoxyethylene is added to the emulsion. However, these methods do not provide sufficiently quick processing times.

JP-A-61-69061 (the term "JP-A" as used herein means an "unexamined published Japanese patent application ")discloses an improved developing process achieved through the addition of polyacrylamides or dextrans. When these polymers are added, however, the film quality deteriorates a great deal in the wet state, e.g., in the wet state, the scratch resistance declines. This in turn causes developing problems.

JP-A-53-44025, JP-A-52-114328, JP-A-56-156826, JP-B-48-43136 (the term "JP-B" as used herein means an "examined Japanese patent publication") disclose a process which speeds up developing by carrying out developing in the presence of a cationic compound.

The present invention surprisingly and unexpectedly discovered that if these two methods were combined, the problem of deterioration of film quality caused by the addition of polymers would be resolved.

SUMMARY OF THE INVENTION

The present invention provides a silver halide photosensitive material exhibiting an improved development rate and excellent film quality in a wet state.

To achieve the above mentioned objectives the present invention provides a silver halide photosensitive material comprising at least one silver halide photographic emulsion layer provided on at least one side of a support, wherein this photosensitive material contains (i) a polymer having the repetitive units represented by formula (II) and/or dextran, and (ii) at least one cationic compound which contains quaternary nitrogen in said photographic emulsion layer and/or another component layer provided on the support:

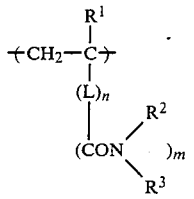

(II)

wherein $R_1$ represents hydrogen or an alkyl group with 1 to 6 carbon atoms; $R^2$, and $R^3$ each represents hydrogen atom, or an unsubstituted or substituted alkyl, aryl or aralkyl group having up to 10 carbon atoms, which may be the same or different, or $R^2$ and $R^3$ are bonded to each other and form a nitrogen-containing heterocyclic ring; L is a linking group of the m+1 valence; n is 0 or 1; and m is 1 or 2.

The objectives of the present invention are believed to be achieved due to the prevention, by the cationic compound containing the quaternary nitrogen, of the diffusion of the polymer containing the repetitive unit represented by formula (II) and/or dextran or the phase separation of the polymer and/or dextran and gelatin.

DETAILED DESCRIPTION OF THE INVENTION

Preferred polymers containing the repetitive units represented by formula (II) suitable for use in the present invention are indicated below.

In general formula (II), $R^1$ indicates hydrogen or an alkyl group with 1 to 6 carbon atoms. Hydrogen and methyl are preferred.

$R^2$ and $R^3$ each represents hydrogen, or a substituted or unsubstituted alkyl, aryl or aralkyl groups having up to 10 carbon atoms; these may be the same or different. Examples of the substituents include hydroxy group, lower alkoxy group (preferably having up to 10 carbon atoms), halogen atom (e.g., cl, Br and F), amide group, cyano group, sulfonic acid group, and carboxylic acid group. Preferably, $R^2$ and $R^3$ represent hydrogen, methyl, ethyl or phenyl; with hydrogen being most preferred.

L represents a linking groups of the m+1 valence and preferably a divalent linking group such as an alkylene group of 2 to 10 carbon atoms, an arylene group of 6 to 10 carbon atoms, or those in combination with an ether bond, an ester bond, an amide bond, etc.

n represents 1 or 0, and 0 is preferable.

m represents 1 or 2, and 1 is preferable.

Preferred examples of ethylenically unsaturated monomers providing the repetitive units represented by formula (II) are:

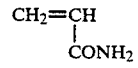

II-1

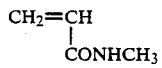

II-2

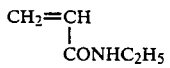

II-3

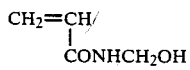

II-4

-continued

II-5

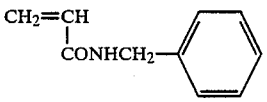

II-6

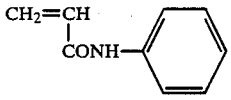

II-7

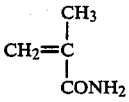

II-8

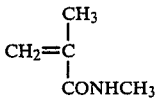

II-9

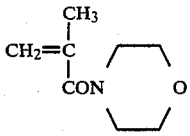

II-10

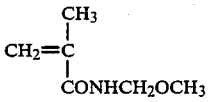

II-11

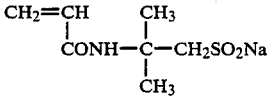

II-12

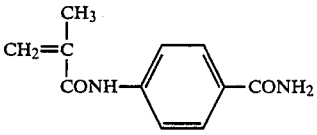

II-13

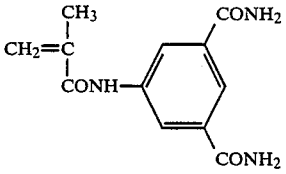

II-14

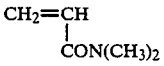

II-15

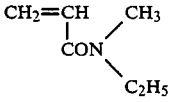

II-16

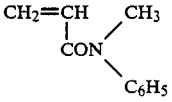

II-17

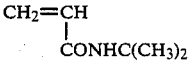

-continued

II-18

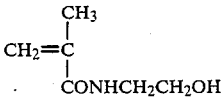

II-19

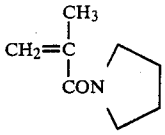

II-20

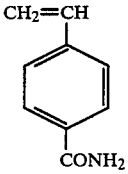

Two or more ethylenically unsaturated monomers as described above may be used to form a polyfunctional polymer.

In the present invention, the polymer contains the monomer unit represented by formula (II) preferably in an amount of at least 70 mol %, more preferably not less than 80 mol %, and most preferably 90 mol %, or more. That is, the polymer used in the present invention is preferably represented by formula (III)

(III)

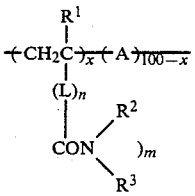

wherein $R^1$, $R^2$, $R^3$, L, n and m are as defined in formula (II); x expresses mol %, and is from 70 to 100; and A represents another monomer unit derived from ethylenically unsaturated comonomer.

Examples of preferred ethylenic unsaturated comonomers which can be used in the polymer of the present invention include ethylene, propylene, 1-butene, isobutene, styrene, chloromethylstyrene, hydroxymethylstyrene, sodium vinylbenzenesulfonate, sodium vinylbenzylsulfonate, N,N,N-trimethyl-N-vinylbenzylammonium chloride, N,N-dimethyl-N-benzyl-N-vinylbenzylammonium chloride, α-methylstyrene, vinyltoluene, 4-vinyl-pyridine, 2-vinylpyridine, benzylvinylpyridium chloride, N-vinylacetoamide, N-vinylpyrolidone, 1-vinyl-2-methylimidazole, monoethylenically unsaturated esters of fatty acids (such as vinyl acetate or ally acetate), ethylenically unsaturated mono- or dicarboxylic acid and their salts (for example, acrylic acid, methacrylic acid, itaconic acid, maleic acid, sodium acrylate, potassium acrylate, sodium methacrylate), maleic anhydride, ethylenically unsaturated mono- or dicarboxylic acid esters (for example, n-butyl acrylate, n-hexyl acrylate, hydroxyethyl acrylate, cyanoethyl acrylate, N,N-diethylaminoethyl acrylate, methyl methacrylate, n-butyl methacrylate, benzyl methacrylate, hydroxyethyl methacrylate, chloroethyl methacrylate, methoxyethyl methacrylate, N,N-diethylaminoethyl methacrylate, N,N,N-triethyl-N-methacryloloxyethylammonium, p-toluene sulfonate, N,N,-diethyl-N-methyl-N-methacryloloxyethylammonium, p-toluene sulfonate, dimethyl itaconate, monobenzyl maleic acid ester). In addition the gelatin-reactive monomers disclosed in JP-A-56-151937, JP-A-57-104927, and JP-A-56-142524 are also suitable. In order to make a polyfunctional polymer, two or more comonomers can be used.

Preferred examples of the polymer used in the present invention are listed below. (The numbers represent mol %).

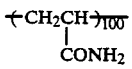
(P-1)

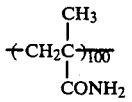
(P-2)

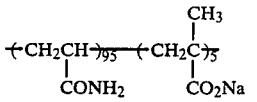
(P-3)

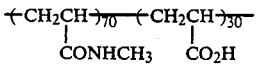
(P-4)

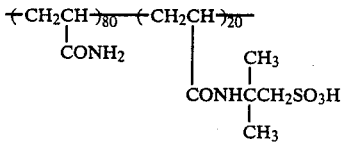
(P-5)

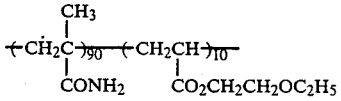
(P-6)

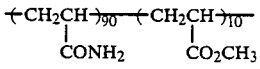
(P-7)

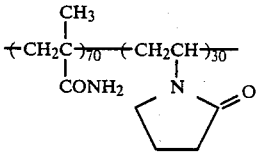
(P-8)

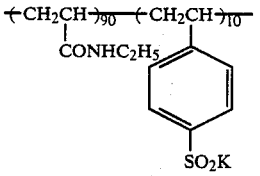
(P-9)

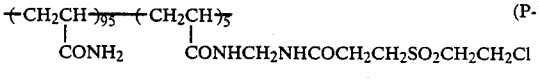
(P-10)

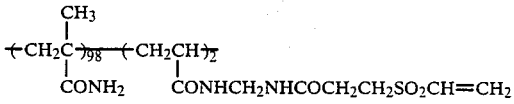
(P-11)

-continued

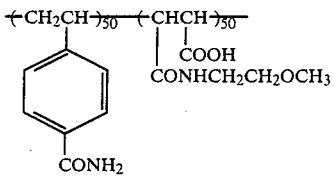
(P-12)

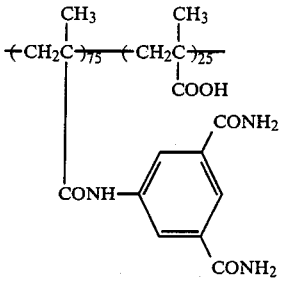
(P-13)

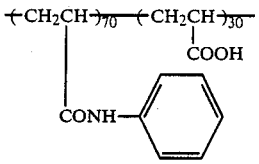
(P-14)

In the present invention, the weight average molecular weight (Mw) of the polymer having the repetitive unit represented by formula (II) which is added to the photographic emulsion is generally from 5,000 to 200,000, preferably from 7,000 to 100,000, and more preferably from 15,000 to 70,000.

The polymer of the present invention can be produced by a conventional method as described, for example, in Takayuki Otsu et al, "Kobunshi Gosei no Jikkenho (Experimental Method for synthesis of Polymer)", pp. 124–154 published by Kagaku Dohjin (1972).

The dextran which can be added to the photographic emulsion layer are obtained by reacting dextransucrase separated from a culture medium of dextran-producing microorganisms (e.g., leuconostoc mesenteroides) with sucrose to obtain native dextran, and partially decomposing and polymerizing the native dextran using an acid, alkali, or enzymes to lower the molecular weight. The weight average molecular weight of the dextran used in the present invention is generally from 10,000 to 300,000, preferably from 15,000 to 200,000, and more preferably from 20,000 to 180,000.

In the present invention it is desirable to add from 5 to 50% by weight, preferably from 10 to 40% by weight, of the polymer containing the repetitive unit represented by general formula (II) and/or dextran to the total binder of all layers (including both light-sensitive and light-insensitive layers) provided on one side of the photosensitive material on which the layer(s) containing the polymer and/or dextran is provided.

In the present invention, the polymer and/or dextran may be incorporated into any of the photographic emulsion layers, but preferably, it should be incorporated in all of the photographic emulsion layers.

Further, it is desirable that the polymer/dextran density (which is expressed in terms of the weight ratio of the amount of the polymer and/or dextran to the amount of the binder in the layer to which the polymer and/or dextran is added) in a photographic emulsion layer closest to the support is lower than those in the other photographic emulsion layers.

It is desirable to further incorporate the polymer and/or dextran in a light-insensitive gelatin layer adjacent to the photographic emulsion layer.

When the polymer and/or dextran is added to various layers of the photographic material, it is preferred that the difference in polymer/dextran density should not be too large between adjacent layers but within 50% of the larger polymer/dextran density.

In particular, it is preferred that the polymer/dextran density in the photographic emulsion layer closest to the support be lower than those in the other photographic emulsion layers, and be from 0 to 30% by weight.

The polymer and/or dextran may also be added to a light-insensitive outermost gelatin layer. In this case, the polymer/dextran density is preferably lower than those of the other layers of the photographic material.

The timing of the addition of the polymer and/or dextran to the emulsion is not crucial. Preferably, the polymer and/or dextran is added after the grain formation and prior to applying the coating.

The polymer and dextran may be added in a powder form or in an aqueous solution. Preferably the polymer and dextran are added in the form of a 5 to 20% aqueous solution.

Next, the cationic compound containing the quaternary nitrogen used in the present invention is described below.

Preferable examples of cationic compounds for use in the present invention are shown by general formulas (IA) and (IB) below:

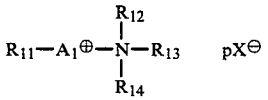

(IA)

-continued

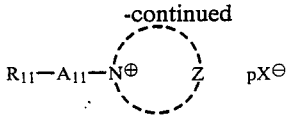

(IB)

In the formulas, $R_{11}$ is an alkyl group with 1 to 26 carbon atoms, and preferably 5 to 20 carbon atoms, an alkenyl group with 3 to 26 carbon atoms and preferably 5 to 20 carbon atoms, a

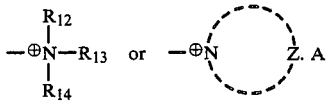

$A_1$ represents a divalent linking group such as an alkylene group of 2 to 20 carbon atoms, an arylene group or those in combination with an ether bond, an ester bond, an amide bond, etc. $R_{12}$, $R_{13}$ and $R_{14}$ each represents an alkyl group preferably having 1 to 18 carbon atoms, and the total carbon atoms of $R_{12}$, $R_{13}$ and $R_{14}$ is preferably not more than 20 carbon atoms. The alkyl group may be substituted with a substituent such as phenyl, an alkoxy group, etc. Z is an atom necessary to form a heterocyclic ring, preferably a 5- or 6-membered heterocyclic ring or a 10-membered fused heterocyclic ring such as pyridine, imidazoline, morpholine, quinoline, etc. p is 1 or 2, and X is an anion such as halogen, an alkylsulfonic acid and toluenesulfonic acid, exemplified with $Cl^{\ominus}$, $Br^{\ominus}$, $CH_3SO_4^{\ominus}$,

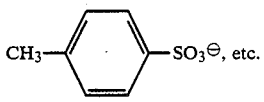

The cationic compound preferably contains an alkyl, alkenyl or alkylene group with 3 to 18 carbon atoms, more preferably with 6 to 18 carbon atoms, as a hydrophobic group.

Specific examples of cationic compounds will be listed below.

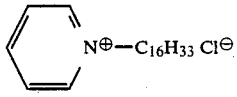

I-1

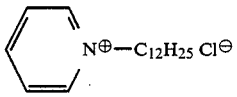

I-2

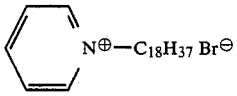

I-3

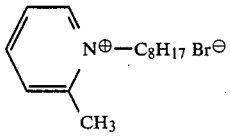

I-4

-continued
I-5
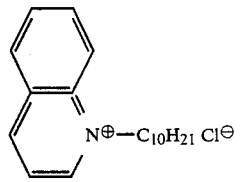
I-6
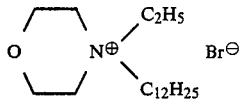
I-7
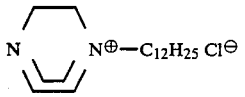
I-8
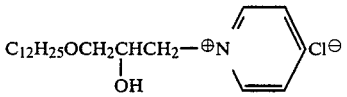
I-9
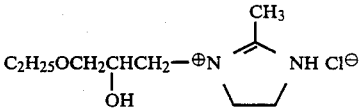
I-10
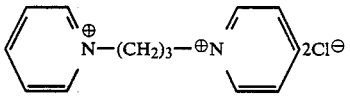
I-11
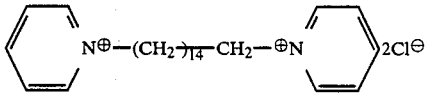
I-12
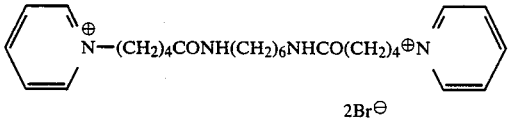
I-13
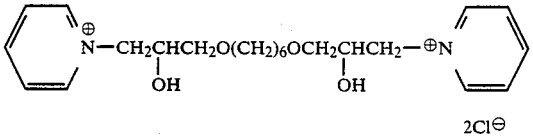
I-14
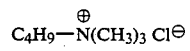
I-15
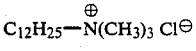
I-16
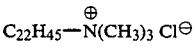
I-17
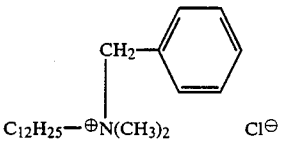
I-18
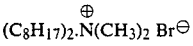

-continued

I-19

$$(C_{12}H_{25})_2\overset{\oplus}{N}(CH_3)_2\ Cl^{\ominus}$$

I-20

$$C_{14}H_{29}-\overset{\oplus}{N}(CH_2CH_2OH)_3\ Cl^{\ominus}$$

I-21

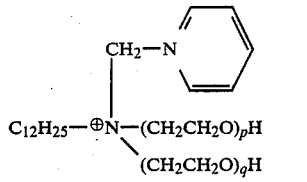

$Cl^{\ominus}$ $p + q = 3$

I-22

$$C_{12}H_{25}-\overset{\oplus}{N}(CH_3)_2-CH_2CH_3$$

$CH_3CH_2SO_4^{\ominus}$

I-23

$$C_{11}H_{23}CONH(CH_2)_3-\overset{\oplus}{N}(CH_2)_3$$

$Cl^{\ominus}$

I-24

$$C_{15}H_{31}CONH(CH_2)_3-\overset{\oplus}{N}(CH_3)_2-CH_2CH_2OH\quad Cl^{\ominus}$$

I-25

$$\text{iso-}C_{17}H_{35}CONH(CH_2)_3-\overset{\oplus}{N}(CH_3)_2-CH_2CH_3$$

$CH_3CH_2SO_4^{\ominus}$

I-26

$$(CH_3)_3\overset{\oplus}{N}-(CH_2)_{10}-\overset{\oplus}{N}(CH_3)_3$$

$2Cl^{\ominus}$

I-27

$$C_{12}H_{25}-\overset{\oplus}{N}(CH_3)_2-CH_2CH_2CH_2-\overset{\oplus}{N}(CH_3)_2-C_{12}H_{25}$$

$2Cl^{\ominus}$

I-28

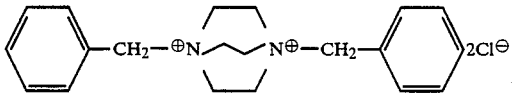

I-29

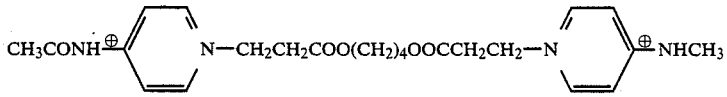

$2Br^{\ominus}$

I-30

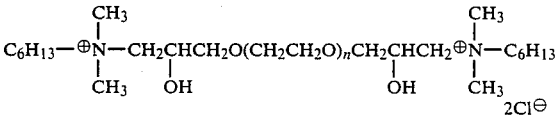

-continued

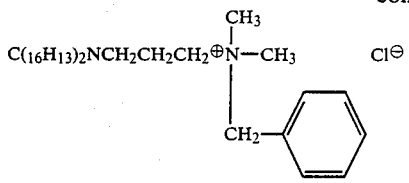

I-31

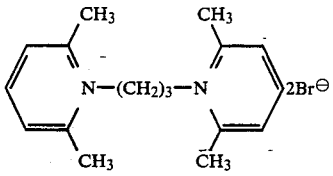

I-32

$C_{16}H_{33}—N^{\oplus}(CH_3)_3\ Cl^{\ominus}$ I-33

$C_{18}H_{37}—N^{\oplus}(CH_3)_3\ Cl^{\ominus}$ I-34

The cationic compound of the present invention can be easily synthesized by a conventional method. For example, the compound I-2, dodecylpyridinium chloride, can be synthesized by reacting dodecyl chloride and a little excess of pyridine with stirring at 120° to 130° C. for 3 to 4 hours and recrystallizing the reaction product from acetone to obtain a needle-like white crystal (m.p. 64° C.; yield 85%).

The cationic compound represented by formula (IA) or (IB) is preferably added in an amount of from $10^{-7}$ to $10^{-3}$ mol/m$^2$, preferably from $10^{-6}$ to $2\times10^{-4}$ mol/m$^2$. The method of addition may be a direct dispersion into a hydrophilic colloid, or, it can be dissolved in an organic solvent such as methanol or ethylene glycol and then added. The cationic compound can be added to any of photosensitive layer and other component layers such as a light-insensitive gelatin layer, an antihalation layer, a filter layer, a color material-containing layer and an interlayer, and it is preferably, added to the layer containing the polymer and/or dextran or in a layer nearer the support than the polymer and/or dextran-containing layer.

Specific examples of silver halides suitable for use in the present invention include silver chloroiodide, silver iodobromide, silver chloroiodobromide, silver chloride, silver bromide and silver chlorobromide. Silver iodobromide is preferred. The content of the silver iodide is preferably from 3 to 30 mol %, and more preferably from 7 to 20 mol %.

The average particle size of the silver halide grains is preferably not less than 0.5 μm. The particle size distribution may be broad or narrow. The silver halide in the emulsion may have a regular shape such as cubic or octagonal, or an irregular shape such as spherical or tabular, or a combination of the two, as well as other shapes. The emulsion may comprise various crystal shapes. In this invention, however, it is preferable that the particles be tabular, with a diameter 5 times or more their thickness.

The detail regarding this type of tabular particle are described in U.S. Pat. Nos. 4,434,226, 4,434,227 and in JP-A-58-127921.

The photosensitive silver halide emulsion used in this invention may be prepared according to the techniques described in P. Glafkides, "Chimie et Physique Photographique" (Paul Montel publishing, 1967); G. F. Duffin, "Photographic Emulsion Chemistry) (The Focal Press, 1966); or in V. L. Zelikman, et al, "Making and Coating Photographic Emulsion" (The Focal Press, 1967).

Suitable known methods for preparing the present silver halide emulsion include the acidic method, the neutral method and the ammonia method, any of which can be used. Soluble silver salts may be reacted with soluble halogen salts, by a single jet method or double jet method.

It is also possible to form the particles using a surplus of silver ions (the so-called reversal mixing process). In the double jet method, silver halide particle may be formed while maintaining pAg in liquid phase constant (the so-called controlled double jet method). According to this method, the crystals formed are regular and of nearly uniform particle size.

One may also mix two types of silver halide particles which have been formed separately.

In the step of forming the silver halide particles, or in the step of physical ripening, cadmium salts, zinc salts, lead salts, thallium salts, iridium salts or their complexes, rhodium salts or their complexes, iron salts or their complexes may also be present.

One may use the photosensitive silver halide emulsion in so-called primitive form without performing chemical sensitization, but normally, chemical sensitization is implemented.

The method for the chemical sensitization may be, for example, that described on pages 675–734 of H. Frieser's "Die Grundlagen der Photographischen Prozesse mit silber-halogeniden" (Akademische Verlagsgesllscharft, 1968).

Suitable known methods include the sulphur sensitization method which employs a sulphur-containing compound capable of reacting with silver ion, or active gelatin; the reduction sensitization method which uses a reducing substance, and the noble metal sensitization method which uses compounds of gold or other noble metal. These methods can be used alone or in combination. Compounds which may be used in the sulphur sensitization method include thiosulfates, thioureas, thiazoles, rhodanines, or other such compounds. Reducing agents include stannous salts, amines, hydrazine derivatives, formamidine sulfinic acid, and silane compounds. In addition to gold complex in the noble metal sensitization method, one may also use complexes of metals in Group VIII of the periodic table of the elements such as platinum, iridium, and palladium.

Various compounds can be added to the above described photosensitive silver halide emulsion to prevent lowering of sensitivity or fog occurred during the manufacturing process, storage, or processing. Such compounds include 4-hydroxy-6-methyl-1,3,3*a*, 7-tetrazaindene, 3-methyl-benzothiazol, 1-phenyl-5-mercapto tetrazol, or additionally, a number of heterocyclic compounds, mercury-containing compounds, mercapto compounds, and metal salts which are known in the art. Antifoggants disclosed in K. Mess, "The Theory of the Photographic Process" (Third Edition, 1966), or in JP-A-49-81024, JP-A-50-6306, JP-A-50-19429, and in U.S. Pat. No. 3,850,639 may also be used for the purpose.

In the present invention, a hydrophilic colloidal layer is used as the protective layer for the silver halide photosensitive material. The protective layer may be a single layer or multiple layers.

There are no particular restrictions on various additives such as matting agent, lubricant, hydrophilic colloid, polymer latex, gelatin hardener, dyes, surfactants, anti-static agents, spectral sensitizers; supports; manufacturing process for the photosensitive materials; or developing or processing methods for use in the present invention. Reference can be made to the specification of JP-A-62-133448, *Research Disclosure*, Item 17643 (Dec. 1978) or Item 18716 (Nov. 1979).

The following table sums up the reference page numbers contained in these *Research Disclosures*:

| Type of Additive | RD 17643 | RD 18716 |
|---|---|---|
| 1. Chemical sensitizers | p. 23 | p. 648 right |
| 2. Sensitizers | — | p. 648 right |
| 3. Spectrally sensitizers & Super sensitizers | p. 23 to 24 | p. 648 right to p. 649 right |
| 4. Whiteners | p. 24 | — |
| 5. Antifoggants & Stabilizers | p. 24 to 25 | p. 649 right |
| 6. Light absorbants, Filter dyes, & U.V. Absorbants | p. 25 to 26 | P. 649 right to p. 650 left |
| 7. Anti-staining agents | p. 25 right | p. 650 left to right |
| 8. Color image stabilizer | p. 25 | — |
| 9. Hardeners | p. 26 | p. 651 left |
| 10. Binders | p. 26 | p. 651 left |
| 11. Plasticizers & Lubricants | p. 27 | p. 650 right |
| 12. Coating aides & Surfactants | p. 26 to 27 | p. 650 right |
| 13. Anti-static agents | p. 27 | p. 650 right |
| 14. Color couplers | p. 28 | p. 647 to p. 648 |

EXAMPLES

The present invention is described in greater detail by reference to the following, but is not to be construed as limited to these examples.

EXAMPLE 1

(1) Preparation of Photosensitive Silver Halide Emulsion

An aqueous gelatin solution was stirred vigorously while adding potassium bromide, potassium iodide and silver nitrate, whereby thick tabular silver iodobromide particles having an average diameter of 1 μ (with an average iodine content of 10 mol %) were formed. Thereafter, the normal precipitation method was used to water wash, and then gold-sulpher chemical sensitization was carried out using chloroauric acid and sodium thiosulfate to prepare photosensitive silver iodobromide emulsion (A). Sensitizing dye-1 was also added prior to the chemical sensitization.

Emulsion (B) was prepared in the same manner as emulsion (A) except that the potassium iodide quantity and the preparation temperature were controlled for emulsion (B) (so average iodine content was 6 mol %).

Sensitizing dye-1: 3.0 mg/l g Ag

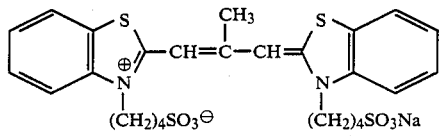

(2) Preparation of Coated Samples

The following compositions were provided on a triacetyl cellulose film in order, to prepare Sample Nos. 1 through 12.

Bottom-most layer

Binder:

Gelatin 1 g/m²

Fixing Promoter: 0.16 g/m²

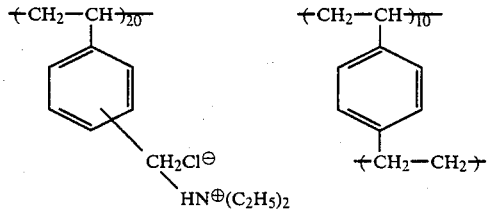

Dyes: $10^{-4}$ mol/m²

-continued

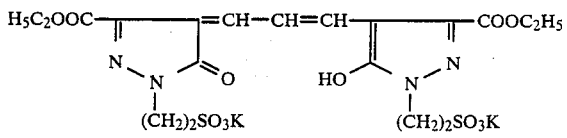

$10^{-4}$ mol/m$^2$

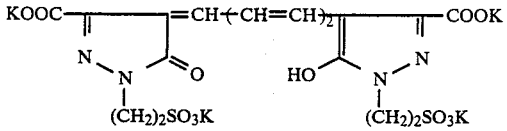

| | |
|---|---|
| Cationic compound: | amount shown in Table 1 |
| Intermediate Layer | |
| Binder: | |
| Gelatin | 0.4 g/m$^2$ |
| Coating aid | |
| Potassium poly-p-styrene sulfonate | 8 mg/m$^2$ |
| Emulsion Layer | |
| Amount of silver in coating: | |
| Emulsion A | 6.3 g/m$^2$ |
| Binder: | |
| Gelatin | 1.6 g/lg Ag |
| Dextran (Mw about 40,000) | amount shown in Table 1 |
| Additives: | |
| $C_{18}H_{35}O(CH_2CH_2O)_{20}H$ | 5.8 g/lg Ag |
| Trimethylol propane | 400 mg/m$^2$ |
| Coating aid: | |
| Potassium poly-p-styrene sulfonate | 1 mg/m$^2$ |
| Surface Protective Layer | |
| Binder: | |
| Gelatin | 0.7 g/m$^2$ |
| Coating aid: | 12 mg/m$^2$ |

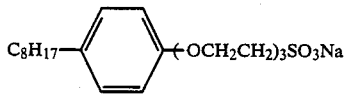

| | |
|---|---|
| Anti-static agent: | 2 mg/m$^2$ |

$C_8F_{17}SO_2N(C_3H_7)CH_2COOK$

| | |
|---|---|
| Hardener: | |
| 1,2-Bis(vinylsulfonyl acetamide)-ethane | $2.3 \times 10^{-4}$ mol/m$^2$ |
| Matting agent: | |
| Polymethyl methacrylate fine particles (average size 3μ) | 0.13 mg/m$^2$ |

(4) Sensitometry

These materials were maintained in a warm, moist enviroment at 25° C. at a relative humidity (RH) of 65% for 7 days after preparation. An optical wedge was used on the samples to perform a 1/10 second exposure at 400 lux with a tungsten lamp and then the processing described below was implemented.

(i) Automatic Developing

HPD developer solution (made by Fuji Photo Film Co., Ltd.) was used to fill an automatic developing machine ("Versamatt 5AN" made by Kodak) and development was performed at 26.5° C. at the rate of 4 ft/min. The sensitivity of the developed samples was then measured.

(ii) Sensitivity Measurements

The sensitivity value was determined by the inverse common logarithm of the necessary exposure light quantity in order to obtain a photographic fog+0.3 of permeation darkening density.

(iii) Scratch Strength in Wet State:

The samples were immersed in distilled water (25° C.) for 3 minutes and the surface of the samples was scratched with a needle (diameter: 0.16 mm) while changing the load on the needle. The amount of load needed for the needle to scratch the surface was taken as a measure of the wet state scratch strength, and is expressed in grams.

TABLE 1

| Sample No. | Amount of Dextran in Emulsion Layer | Cationic Compound in Bottom-most Layer (amount: mg/m$^2$) | Relative Sensitivity* | Scratch Strength in Wet Condition (g) |
|---|---|---|---|---|
| 1 | — | — | 100 | 140 |
| 2 | — | I-2 (5) | 109 | 140 |

TABLE 1-continued

| Sample No. | Amount of Dextran in Emulsion Layer | Cationic Compound in Bottom-most Layer (amount: mg/m$^2$) | Relative Sensitivity* | Scratch Strength in Wet Condition (g) |
|---|---|---|---|---|
| 3 | — | I-2 (10) | 120 | 140 |
| 4 | — | I-2 (20) | 132 | 140 |
| 5 | 1.9 g/m$^2$ | — | 180 | 55 |
| 6 | " | I-2 (5) | 200 | 85 |
| 7 | " | I-2 (10) | 225 | 110 |
| 8 | " | I-2 (20) | 245 | 140 |
| 9 | " | I-15 (10) | 210 | 110 |

*The relative sensitivity was determined taking the sensitivity of sample 1 as being 100.

It is seen from Table 1, that the samples containing both dextran and the cationic compound of the present invention exhibited extremely high sensitivity and high scratch resistance in the wet state.

EXAMPLE 2

(1) Preparation of Emulsion:

This was the same as in Example 1.

(2) Preparation of Coating Materials:

The various layers described below were formed in order atop a film of triacetyl cellulose to prepare Sample Nos. 13 through 15.

Bottom layer

This was the same as in Example 1.

Intermediate layer

This was the same as in Example 1.

| | |
|---|---|
| Emulsion layer 1 | |
| Amount of silver in the coating: | |
| First emulsion (emulsion B) | 1.3 g/m$^2$ |
| Binders: | |
| Gelatin | 1.9 g/m$^2$ |
| Dextran (Mw about 40,000) | 0.7 g/m$^2$ |
| Additives: | |
| $C_{18}H_{35}O—CH_2CH_2O—_{20}H$ | 5.8 mg/lg Ag |
| Cationic compound: | amount shown in Table 2 |
| Coating aid: | |
| Potassium poly-p-styrene sulfonate | 0.2 mg/m$^2$ |
| Emulsion layer 2 | |
| Amount of silver in the coating: | |
| First emulsion (emulsion A) | 4.2 g/m$^2$ |
| Binders: | |
| Gelatin | 7.8 g/m$^2$ |
| Dextran (Mw about 40,000) | 1.5 g/m$^2$ |
| Additives: | |
| $C_{18}H_{35}O—CH_2CH_2O—_{20}H$ | 5.8 mg/lg Ag |
| Trimethylol propane | 400 mg/m$^2$ |
| Coating aid: | |
| Potassium poly-p-styrene sulfonate | 0.7 mg/m$^2$ |

Surface Protecting Layer

Same as in Example 1

(3) Sensitometry

Same as in Example 1

TABLE 2

| Sample No. | Cationic Compound in Emulsion Layer 1 (amount: mg/m$^2$) | Relative Sensitivity | Wet Scratch Strength |
|---|---|---|---|
| 10 | — | 100 | 45 |
| 11 | Compound (I-1) (2) | 120 | 57 |
| 12 | Compound (I-1) (5) | 145 | 70 |
| 13 | Compound (I-1) (10) | 170 | 85 |

The relative sensitivity was determined taking the sensitivity of sample 10 as being 100.

As may be seen from Table 2, when dextran is included in the photosensitive materials, the sample which contained the cationic compound of the present invention exhibited high sensitivity and high scratch resistance when wet.

While the invention has been described in detail and with reference to specific embodiments thereof, it will be apparent to one skilled in the art that various changes and modifications can be made therein without departing from the spirit and scope thereof.

What is claimed is:

1. A silver halide photosensitive material comprising at least one silver halide photographic emulsion layer provided on at least one side of a support, said photosensitive material containing in the photographic emulsion layer and/or another component layer (i) a polymer having repetitive units represented by formula (II), dextran or mixtures thereof, and (ii) at least one cationic compound containing quaternary nitrogen:

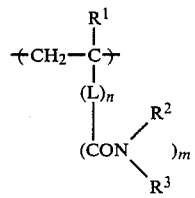

(II)

wherein $R_1$ represents hydrogen or an alkyl group with 1 to 6 carbon atoms; $R^2$, and $R^3$ each represents hydrogen, or an unsubstituted or substituted alkyl, aryl or aralkyl group having up to 10 carbon atoms, or $R^2$ and $R^3$ are bonded to each other to form a nitrogen-containing heterocyclic ring; m represents 1 or 2; n represents 0 or 1; and L represents a linking group of the valence m+1.

2. A silver halide photosensitive material according to claim 1, wherein said cationic compound is represented by formula (IA) or (IB);

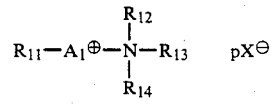

(IA)

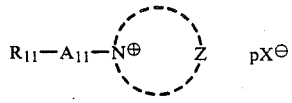

(IB)

wherein $R_{11}$ represents an alkyl group having 1 to 26 carbon atoms, an alkenyl group having 3 to 26 carbon atoms, a

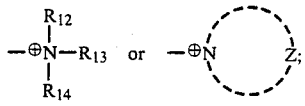

$A_1$ represents a divalent linking group; $R_{12}$, $R_{13}$ and $R_{14}$ each represents an alkyl group which may be substituted; Z represents an atomic group necessary to form a heterocyclic ring; p represents 1 or 2; and X represents an anion.

3. A silver halide photosensitive material according to claim 1, wherein said polymer having repetitive units is represented by general formula (III):

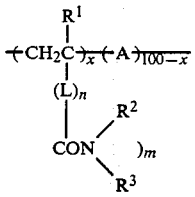

(III)

wherein $R^1$, $R^2$, $R^3$, L, n and m are as defined in formula (II); x represents mol percent and is from 70 to 100 percent; and A represents another monomer unit derived from a polymerizable ethylenically unsaturated comonomer.

4. A silver halide photosensitive material according to claim 1, wherein the component (i) is dextran.

5. A silver halide photosensitive material according to claim 1, wherein $R^1$ is selected from the group consisting of a hydrogen atom and a methyl group, $R^2$ and $R^3$ are selected from the group consisting of a hydrogen atom, a methyl group, an ethyl group and a phenyl group, n represents 0 and m represents 1.

6. A silver halide photosensitive material according to claim 5, wherein $R^2$ and $R^3$ represent a hydrogen atom.

7. A silver halide photosensitive material according to claim 3, wherein $R^1$ is selected from the group consisting of a hydrogen atom and a methyl group, $R^2$ and $R^3$ are selected from the group consisting of a hydrogen atom, a methyl group, an ethyl group and a phenyl group, n represents 0, and m represents 1.

8. A silver halide photosensitive material according to claim 7, wherein $R^2$ and $R^3$ represent a hydrogen atom.

9. A silver halide photosensitive material according to claim 1, wherein the weight average molecular weight of the polymer having repetitive unit of formula (II) is from about 5,000 to 200,000 and the weight average molecular weight of the dextran is from about 10,000 to 300,000.

10. A silver halide photosensitive material according to claim 1, wherein the component (i) is added to the photosensitive material in an amount of from about 5 to 50 percent by weight based on the weight of total binder of all layers provided on one side of the photosensitive material on which a layer containing the component (i) is provided, and the cationic compound is added to the photosensitive material in an amount of from about $10^{-7}$ to $10^{-3}$ mols per $m^2$.

11. A silver halide photosensitive material according to claim 10, wherein the component (i) is added to the photosensitive material in an amount of from about 10 to 40 percent by weight based on the weight of total binder of all layers provided on one side of the photosensitive material on which a layer containing the component (i) is provided, and the cationic compound is added to the photosensitive material in an amount of from about $10^{-6}$ to $10^{-4}$ mols per $m^2$.

* * * * *